US005783768A

United States Patent [19]

Jacobson

[11] Patent Number: 5,783,768

[45] Date of Patent: Jul. 21, 1998

[54] FIRE STARTING FLARE

[75] Inventor: Michael D. Jacobson, Ridgecrest, Calif.

[73] Assignee: Quoin, Inc., Ridgecrest, Calif.

[21] Appl. No.: 598,246

[22] Filed: Feb. 8, 1996

[51] Int. Cl.[6] ..... F42B 4/26; C06D 3/00

[52] U.S. Cl. ..... 102/334; 102/336; 149/108.2

[58] Field of Search ..... 102/334, 336; 149/108.2

[56] References Cited

U.S. PATENT DOCUMENTS

| | | | |
|---|---|---|---|
| 3,566,791 | 3/1971 | Lohkamp | 102/32 |
| 3,654,867 | 4/1972 | Murray | 102/37.4 |
| 3,713,393 | 1/1973 | O'Connor et al. | 102/70 |
| 4,023,493 | 5/1977 | Austin et al. | 102/22 R |
| 4,080,227 | 3/1978 | Hartzel et al. | 149/22 |
| 4,365,557 | 12/1982 | Couture et al. | 102/341 |
| 4,432,816 | 2/1984 | Kennedy et al. | 149/19.3 |
| 4,860,657 | 8/1989 | Steinicke et al. | 102/334 |
| 4,880,483 | 11/1989 | Baldi | 149/6 |
| 5,022,470 | 6/1991 | Anderson et al. | 175/14 |
| 5,159,983 | 11/1992 | Barron et al. | 166/379 |
| 5,463,169 | 10/1995 | Hebisch et al. | 588/202 |
| 5,472,533 | 12/1995 | Herbage et al. | 149/22 |
| 5,499,582 | 3/1996 | Schiessl et al. | 102/334 |

OTHER PUBLICATIONS

U.S. Dept. of Agriculture, *Ground Ignition Systems: An Equipment Guide for Prescribed and Wild Fires*, Forestry Service, Tech. & Dev. Program, 5100–Fire, Mar., 1993, 9351–2806–MTDC.

*Primary Examiner*—Peter A. Nelson
*Attorney, Agent, or Firm*—Kenneth G. Pritchard

[57] ABSTRACT

A fire starting flare suitable for hand-held launchers has a fuse and ignitor assembly within a flare core material such that as the flare is launched the fire ignites and as the flare lands the fuse reaches the ignitor assembly to set off the flare.

8 Claims, 1 Drawing Sheet

FIRE STARTING FLARE

BACKGROUND OF THE INVENTION

This invention relates to incendiary devices to initiate firebreaks and the like. More particularly it relates to incendiary devices that permit brush fires to be started remotely from the person controlling the device.

Forest and brush fires are major problems for both the communities and firefighters that have to deal with them on a regular basis, such as the western part of the United States. Forest fires can be either controlled or prevented by intentionally igniting fires. As a control mechanism, a fire can be set to burn off accumulated fuel during a season where there is little chance of creating an uncontrolled fire. This is called a controlled burn. The following description is for the control of wild fires, although, similar conditions exist for the controlled burn. For most of these fires, the goal is to gain control as quickly as possible. One technique regularly employed to establish control is the backfire where areas in the fire's path are burned to deprive the fire of fuel thereby creating a buffer zones that impedes the fires. A large variety of devices have been used to start these backfires. A partial list includes matches, electric lighters, hand-thrown devices, fuses, drip torches, plastic bags of gelled fuel, canister devices, pneumatic torches, propane torches, power flame throwers, flare pens, signal pistols, and various launching devices. Launching devices range from compressed air to slingshots.

For a detailed description of all of these devices with warnings about their dangers and limitations, the United States Department of Agriculture, Forest Service, has a detailed book called "Ground Ignition Systems: An Equipment Guide for Prescribed and Wild Fires." In summary all current devices have severe restrictions. Setting a backfire is a race against time. An out of control fire is advancing towards the firefighters in the area of a designated backfire location. The firefighters first have to assure that the fire they are starting will burn in a direction they can control. Next the firefighters have to start the backfire over a large enough area and give it adequate time to burn away from the fire line they have set to define the backfire and towards the fire to be controlled.

In order for the firefighters to burn large areas, it is necessary to first light a small continuous fire adjacent to a trail or road, then launch flares beyond the small fire line. The launched flares produce a fire that will draw the smaller fire line towards it. The combination produces a fire line of considerable width.

In general, state of the art devices have limited fire-starting performance, many are rated as explosives, some of the devices are high cost, and most burn and/or explode easily. Further, they may require supporting devices such as air compressors to be launched. Several of them require a firefighter to take the device to the stage where the fire is to be started. This leads to firefighters walking inside the fire line starting the extension fires. Such activity puts the firefighter at increased personal risk, especially when the terrain is very rough.

Thus the prior techniques required coordination of equipment, protection of explosive/combustive materials in the midst of a fire area, and the time of assuring fires were started along a fire line an adequate time.

SUMMARY OF THE INVENTION

Accordingly, the general purpose of the present invention is to provide a device which uses materials with greater safety margins in a fire zone, requires minimal supporting equipment, and does not require a firefighter to be at the exact location to assure ignition of a backfire.

One embodiment of the invention uses a flammable plastic or paper case that is filled with a flare core material which is difficult to ignite, but produces an extremely hot flame once it burns. An ignitor cord, which will be referred to as a fuse, is routed through the flare core from the aft end to the fore end. The fuse terminates in a small aluminum foil ignitor bag filled with a first fire mix. The first fire mix may be a starting powder or a starting paste. The ignitor bag is embedded in pellets of a thermite starter surrounded by a second layer of aluminum foil. The second foil layer is embedded in the flare core. The flare case is closed at both ends. In effect, this embodiment consists of a delay fuse, an ignitor assembly and a flare core housed in a consumable casing. To deliver the flare to a desired location, it is expelled from a launcher, preferably a hand-held launcher.

For a hand-held launcher, the completed flare is put into the launcher muzzle, a blank cartridge is inserted in the breech, and a firing mechanism is threaded over the breech. The launcher is held in one hand and aimed at the direction desired and a firing pin is released. The blank cartridge fires, accelerating the flare and igniting the fuse. The fuse burns as the flare flies a ballistic course to the impact point. Approximately one second later, the fuse ignites the thermite starter and the flare. The flare burns vigorously for fifteen seconds. This high temperature flame ignites grasses, sage brush and other combustible materials. The range of the flare is determined by the elevation of the launcher when fired. With a range of one hundred thirty yards, a single firefighter can effectively burn hundreds of square yards.

In another embodiment, the launcher can be made into a repeating mechanism to launch flares from a helicopter for aerial delivery.

DESCRIPTION OF THE PREFERRED EMBODIMENT

Figure 1:
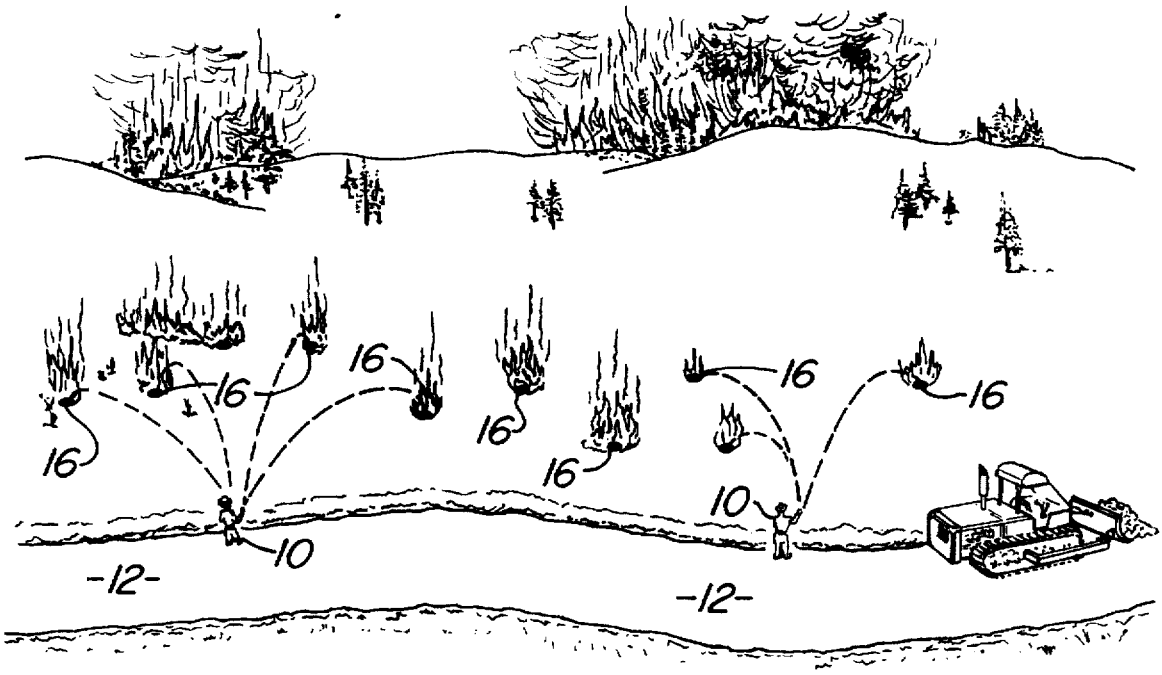
FIG. 1 is a map of a typical fire line.

FIG. 1 is an area view of how a single firefighter can start backfires over a large area. Firefighter 10 may stand behind a fire line 12 which has been cleared as necessary to allow a backfire to be started. Very small fires, not shown, may be started along the upper edge of the fire line 12 in the usual manner to be drawn to the bulk of the backfire started further in from fire line 12. Using launcher 14 shown in a later figure, firefighter 10, can place a pattern of incendiary flares at locations 16 to start a backfire. The shown pattern of location 16 is arbitrary and is expected to vary as needed to light the backfire. Should any individual location fail to ignite from a flare, multiple launches of other flares can be made. Thus, firefighter 10 actually improves the chances of a successful start of a backfire by remaining in one place. Any location 16 that does not ignite does not require firefighter 10 to backtrack along a fire line 12 to a location that may have failed to ignite or continue to burn once started. Firefighter 10 never has to be in the area of the backfire which adds safety as well as speed to this method of starting a backfire.

Figure 2:
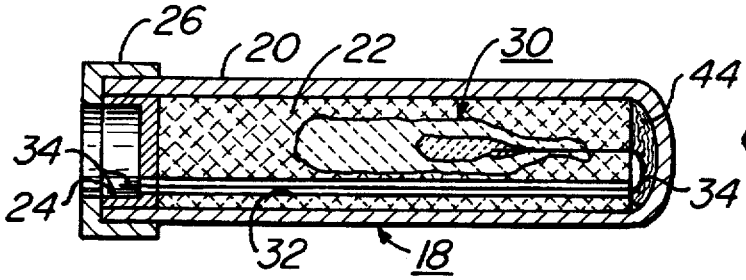
FIG. 2 is a cutaway view of a flare that is part of the present invention.

FIG. 2 is a cutaway view of a flare 18, a tubular casing 20, ideally a flammable plastic or paper tube or similarly shaped material, is filled with core material 22 which is a material that once ignited will burn intensely and emit flame from the ends of casing 20. There are numerous materials that will function this way, one example being a mixture of 120 grit aluminum powder mixed with equal weight of plaster. These materials can be mixed with water and polyvinyl glue to a free flowing mixture so core material 22 is easily poured into casing 20. After curing, this material is difficult to ignite and can be drilled to insert items into core material 22.

A plug 24, such as a metal washer or a plastic or paper cup, is attached to the core material 22 at the back of flare 18 by bonding material, such as thermal setting glue. Plug 24 will also serve as a deflector for propellant charge gases and as a seal to prevent blow-by, or leakage of propellant gases while the flare is in the launcher. A cap 26 covers the aft end of the flare and protects the fuse from environmental humidity and debris. The cap also protects the fuse from inadvertent ignition from matches and other such devices. A forward plug 14 of thermally hardening material such as high melting temperature wax, environmentally seals the front of the flare. The combination of casing 20, forward plug 44 and cap 26 completely encase all combustible materials as ignition is only possible by preset access.

Prior to casting flare 18, an ignitor assembly 30 is inserted into casing 20. A mandrel or rod, not shown, may be placed into casing 20 prior to the casting. This rod is then removed after casting to create a hole 32 through core material 22 for a fuse 34 to be routed. For our purposes the term "fuse" means the same as ignitor cord. There are numerous ways to crate hole 32 which include drilling and wrapping fuse 34 in aluminum foil. Any method may be used.

Figure 3:
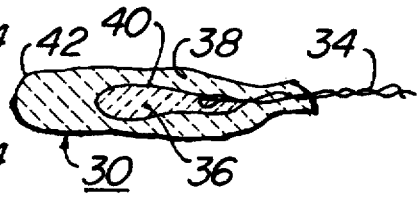
FIG. 3 is a perspective view of an ignitor assembly.

FIG. 3 shows an ignitor assembly 30. Ignitor assembly 30 consists of a fuse 34, first fire mix 36, and thermite starter 38. Fuse 34 is any commercially available ignitor cord. Placed about the end of fuse 34 is first fire mix 36, such as a commercially available starting powder mixture of di-copper oxide, aluminum powder and red phosphorous. First fire mix 36 is encased in a first metallic bag 40 such as aluminum foil. Placed about this assembly is a thermite starter 38 in the form of pellets. Thermite starter 38 may consist of a mixture of 400 grit aluminum powder, iron oxide, thermite and plaster to which is added water and polyvinyl acetate. To those skilled in the art it is clear other combustible mixtures could be used as long as the flame temperature exceeds 2000° F., and the burn time exceeds 100 milliseconds, and the reaction is relatively gas free. Excessive gas production could cause the flare to blow apart. Thermite starter 38 is in turn encased in a second metallic bag 42 which could also be aluminum foil.

Figure 4:
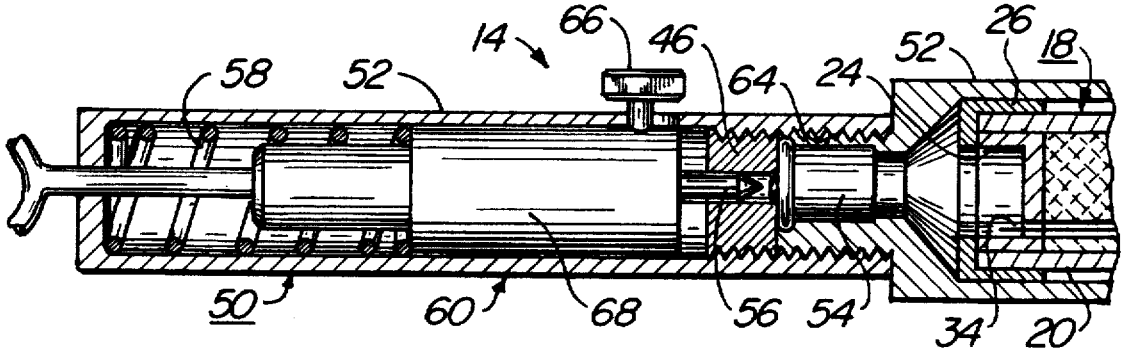
FIG. 4 is a cutaway view of a launcher.

FIG. 4 is a view of a launcher 50. Launcher 50 has a barrel 52 which can be made of steel or similar material which holds flare 18 and a launching cartridge 54, such as a blank for a 0.32 caliber Smith & Wesson cartridge. A firing pin 56 is spring mounted within a housing 60. When firing pin 56 is pulled away from launching cartridge 54, spring 58 is compressed. When released, spring 58 via a hammer 68 drives firing pin 56 into launching cartridge 54 which fires. This rapid burning creates hot, high pressure gases which burst the cap 26, press on the plug 24 to accelerate flare 18, and at the same time ignite the end of fuse 34 of ignitor assembly 30. As fuse 34 burns through forward plug 44, the heat softens forward plug 44 and provides a vent path so the device does not build combustion gases that might otherwise cause a pressure rupture.

It has been found that drilling to place fuse 34 and so forth results in a slower burn time as fuse 34 vents. A slower burn time is desired as the strength of launching charge 54 increases. In effect, the more kick possessed by launching charge 54 the further away flare 18 is propelled. As flight time increases, it is more desirable to not have fuse 34 ignite first fire mix 36, and so forth until flare 18 is on the ground.

Returning to FIG. 4, firing pin assembly 60 has a housing 62 which may be a support tube made of steel or similar material that is sealed at one end and with threads 64 at the other end to permit attachment to barrel 52 which has matching threads as shown. A position plug 64, again of appropriate metal serves to hold cartridge 54 in place within barrel 52 and at the same time align firing pin 56 to the primer of cartridge 54. A thumb release 66 is attached to a hammer 68 which can be formed as one piece with firing pin 56. Hammer 68 is designed to compress and align spring 58 when thumb release 66 is pulled back. When thumb release 66 is released, spring 58 propels hammer 68 with firing pin 56 into cartridge 54. Firing of cartridge 54 propels flare 18 out of barrel 52. Unscrewing barrel 52 from firing pin assembly 60 permits the spent cartridge to be removed from the break and a new cartridge 54 to be inserted.

Flare 18 is propelled from the launcher at speeds of up to 200 feet per second. Flare 18 flies a ballistic trajectory to the desired landing area. If the landing area is either compacted earth or contains rocks, the front of flare 18 provides a cushioning effect. The twisted fuse and wax plug 44 absorb the energy of flare 28 as it strikes a hard surface by a combination of spring action and crushing. This cushioning effect is important to maintaining the structural integrity of flare 18 after it strikes a rock. Fuse 34 is a soft material that will continue to meet its desired function despite being hit hard during landing.

An alternative is for the flare to replace the shot from a shot gun cartridge. In this option the flare is fabricated with a shot shell wad as an integral part. Then the flare is assembled in the same manner as a normal shot gun shell. The launcher can now be a shot gun or other launcher device that has a barrel and will accept the modified shell.

Another alternative is for the blank cartridges to be contained in a magazine that would allow multiple firings without reloading blanks between firings.

In general the present device functions as follows:

Fuse 34 protrudes from the back of flare 18. Internal to flare 18, fuse 34 is located in a void volume such as a drilled hole or inside a plastic tubing. Fuse 34 is routed to the front: of flare 18 and wrapped in a tight coil. The coil is then embedded in the forward wax plug 44. Fuse 18 is then routed to a first metallic bag 40 filled with first fire mix 36, where fuse 34 terminates. Again, first fire mix 36 is a commercially available welding powder for joining large copper wires and pipes. Another option for first fire mix 36 is ball powder made into a paste with acetone, lacquer, magnesium, and black powder. The bag of first fire mix 36 is surrounded by pellets of thermite starter 38 which is in turn surrounded by a second metallic bag 42. Fuse 34 and ignitor assembly 30 are inserted into flare casing 20, which has been prepared by injecting molten wax plug 44, prior to pouring the flare core.

An alternative way to obtain this same configuration is to insert all components into core material 22 after it is poured, but before it hardens. In this approach, the fuse 34 and the ignitor assembly 30 combination can be wrapped in a reinforcing cloth that will improve the structural capability of the flare after it dries. In so doing, it is possible to make a flare that does not require a casing.

Fuse 34 is basically a combustible cord which burns at a prescribed rate. However, it is essential that fuse 34 not be confined so as to create high pressure, since this causes fuse 34 to burn at a much higher rate. Therefore, it is necessary to create an air pocket surrounding fuse 34 so that the combustion gases have a vent path and do not cause high local pressures around the fuse. This air pocket is formed by drilling the finished flare core or by forming a suitable air cavity during casting of the flare core. A fuse thus vented will provide for a predictable ignition delay time from launch until the flare lands at the desired point of ignition.

Fuse 34 terminates in a first fire mix 36 that is commercially available as a part of copper-based welding powder. This first fire mix 36 can be ignited by the fuse, which burns without much heat output. The first fire mix 36 may contain di-copper oxide, aluminum and red phosphorous, all in powder form. The powders are placed in a first metallic foil bag or pouch with fuse 34 immersed in the powder. This first metallic bag 40 is tightly sealed. When ignited by fuse 34, first fire mix 36 rapidly burns and consumes the powder as well as the first metallic bag 40, producing a very hot liquid metal and a small amount of gaseous flame.

An alternate to the first fire mix being a starting powder is a combustible paste made of lead oxide and silicon which is suspended in lacquer and acetone. Fuse 34 is immersed in the paste and then removed to dry.

A thermite starter 38 is ignited by the first fire mix 36 and burns to ignite the flare core material 22. This thermite starter mix is formed by combining plaster, aluminum powder, black iron oxide, and welding thermite. This combination is mixed with water and polyvinyl acetate adhesive to form a paste. The paste is processed to produce ⅛ inch cubic or cylindrical pellets and allowed to cure and dry. Pellets can be made by spreading the paste to a thickness of ⅛ inch on a flat surface then scoring with a knife or by extrusion and cutting to length. A second metallic bag 42 is formed with the bag of first fire 365 at its center and the thermite starter 38 pellets surrounding. The second metallic bag 40 is also tightly folded or otherwise sealed.

Fuse 34 may be twisted and immersed in the forward wax plug 44. The fuse thus prepared is positioned such that the twisted area and the wax plug are located at the very front of the flare. The fuse thus prepared is positioned such that this twisted area is located at the very front of the flare. As the fuse burns, it melts the wax plug 44 in the front of the flare. The plug thus melted will allow the combustion gases to escape from the flare without creating excessive internal pressure.

Flare 18 is formed by installing ignitor assembly 30 in casing 20 and casting core material 22. One end of casing 20 is sealed. Ignitor assembly 30 is placed into casing 20 in such a manner that the bare end of fuse 34 protrudes out the back of flare 18 and the tip of ignitor assembly 30 extends to the front of flare 18. In this manner, the fuse is ignited by the propulsion charge and burns through the flare core without causing a high internal pressure. The fuse also melts the wax plug 44 at the front of the flare providing a weakened area for venting the gases produced by ignitor assembly 30 when it ignites. Fuse 34 ignites the first fire mix 36, which in turn ignites the thermite starter 38 pellets, then the burning pellets ignite flare 18's core material 22 and in turn flare casing 20. This ignition train is necessary because fuse 34 cannot ignite either the pellets or flare core material 22. The first fire mix 36 will not ignite the flare core material 22 but will ignite the thermite starter 38 pellets. The thermite starter 38 pellets burn more slowly than first fire mix 36 all the while producing a very hot flame and liquid metal. Finally, thermite starter 38 ignites the flare core material 22. Flare 18 will ignite ground fires 16 because of the extremely hot flame and liquid metals that are expelled by the burning flare core material 22.

What is claimed is:

1. A fire starting flare comprising:

A. a casing with two ends, one open and the other closed;

B. combustible core material within said casing of 120 grit aluminum powder mixed with equal weight of plaster;

C. a cap placed over the open end of said casing capable of being ruptured by high pressure;

D. an ignitor assembly placed within said combustible core material within said casing; and E. a fuse which extends from the outside of said predesigned hole in said plug, through said hole and through said combustible core material to said ignitor assembly, to which said fuse is operably connected.

2. A fire starting flare as described in claim 1 wherein said ignitor assembly further comprises:

A. a first fire mix operably in contact with said fuse;

B. a first metallic bag enclosing said first fire mix;

C. a thermite starter placed about said first metallic bag; and

D. a second metallic bag enclosing said thermite starter.

3. A fire starting flare comprising:

A. a casing with two ends, one open and the other closed;

B. combustible core material within said casing;

C. a cap placed over the open end of said casing capable of being ruptured by high pressure;

D. an ignitor assembly placed within said combustible core material within said casing which comprises:

(1) a first fire mix operably in contact with said fuse;

(2) a first metallic bag enclosing said first fire mix;

(3) a thermite starter of 400 grit aluminum powder, iron oxide, thermite, and plaster to which is added water and polyvinyl acetate; and (4) a second metallic bag enclosing said thermite starter.

4. A fire staring flare comprising:

A. a casing with two ends, one open and the other closed;

B. combustible core material within said casing;

C. a cap placed over the open end of said casing capable of being ruptured by high pressure;

D. An ignitor assembly placed within said combustible core material within said casing which comprises:

(1) a first fire mix of di-copper oxide, aluminum powder, and red phosphorous operably in contact with said fuse;

(2) a first metallic bag enclosing said first fire mix;

(3) a thermite starter placed about said first metallic bag; and (4) a second metallic bag enclosing said thermite starter; and E. a fuse which extends from the outside of said predesigned hole in said plug, through said hole and through said combustible core material to said ignitor assembly, to which said fuse is operably connected.

5. A fire starting flare as described in claim 3 where said first and second metallic bags are aluminum foil.

6. A fire starting flare as described in claim 2 where said first and second metallic bags are aluminum foil.

7. A fire starting flare as described in claim 2 where said first and second metallic bags are aluminum foil.

8. A fire starting flare as described in claim 8 where said first and second metallic bags are aluminum foil.

* * * * *